US005383436A

United States Patent [19]

Fehlmann

[11] Patent Number: 5,383,436

[45] Date of Patent: Jan. 24, 1995

[54] FUEL INJECTION PUMP FOR INTERNAL COMBUSTION ENGINES

[75] Inventor: Wolfgang Fehlmann, Stuttgart, Germany

[73] Assignee: Robert Bosch GmbH, Stuttgart, Germany

[21] Appl. No.: 201,958

[22] Filed: Feb. 25, 1994

[30] Foreign Application Priority Data

May 11, 1993 [DE] Germany ..... 4315646

[51] Int. Cl.[6] ..... F02M 41/00

[52] U.S. Cl. ..... 123/450; 417/462; 123/506

[58] Field of Search ..... 123/450, 506, 500, 501, 123/458; 417/462, 214, 218, 219, 440

[56] References Cited

U.S. PATENT DOCUMENTS

| | | | |
|---|---|---|---|
| 3,847,509 | 11/1974 | Bonin | 417/214 |
| 4,357,925 | 11/1982 | Woodruff | 123/450 |
| 4,453,896 | 6/1984 | Vilardo | 123/450 |
| 4,575,316 | 3/1986 | Mowbray | 417/462 |
| 4,625,694 | 12/1986 | Adey | 417/462 |
| 4,691,679 | 9/1987 | Lakin | 123/506 |
| 4,840,162 | 6/1989 | Brunel | 123/450 |
| 4,913,632 | 4/1990 | Thornwaite | 417/219 |
| 4,915,592 | 4/1990 | Hishinuma | 417/462 |
| 5,215,060 | 6/1993 | Klopfer | 123/450 |
| 5,265,576 | 11/1993 | McMahon | 123/506 |

FOREIGN PATENT DOCUMENTS 3928613 3/1991 Germany .

*Primary Examiner*—Carl S. Miller

*Attorney, Agent, or Firm*—Edwin E. Greigg; Ronald E. Greigg

[57] ABSTRACT

A fuel injection pump of the radial piston distributor injection pump type which includes pump pistons, which during execution of their intake stroke, are acted upon from a side of a pump work chamber with fuel at a first, higher pressure, which is taken from a suction chamber. The pump pistons on their opposite outer face ends are acted upon by a pressure of a lesser magnitude, and this latter pressure is adjusted in a chamber that is divided from the suction chamber by a movable diaphragm. Hence mechanical restoring means for the pump pistons for executing their intake stroke are dispensed with.

21 Claims, 2 Drawing Sheets

FUEL INJECTION PUMP FOR INTERNAL COMBUSTION ENGINES

BACKGROUND OF THE INVENTION

The invention relates to a fuel injection pump as defined hereinafter.

A fuel injection pump of this kind has been disclosed, for instance by German Offenlegungsschrift 39 28 613. In this known embodiment, the fuel reservoir is embodied as a diaphragm reservoir and is a component that is flanged laterally to the injection pump housing. This component makes the installed size of the injection pump larger and causes problems if the fuel reservoir is made large. Yet a small fuel reservoir has the disadvantage that in the intake stroke the pressure in the suction chamber drops excessively, which once again impedes the function. Aside from this, flanging the fuel reservoir on the outside creates additional surfaces that must be sealed off from the outside, which in turn increases the danger that fuel may escape at the surface of the injection pump.

The known pump also has a pump piston, which is driven by the cam drive to reciprocate and at the same time rotate. The pump and distributor piston is retained in the process, by its end protruding into the suction chamber, against a roller ring by means of a spring together with a cam disk; because of the motion of the pump piston, the volume of the cam chamber varies periodically, and is associated with periodic, brief changes in pressure, which in the intake stroke are utilized to improve the process of filling the pump work chamber, because the movable wall embodied as a diaphragm is deflected by the pressure pulses toward the cam chamber. The pressures in the suction chamber and in the cam chamber should be approximately equal for that purpose.

OBJECT AND SUMMARY OF THE INVENTION

The fuel injection pump according to the invention has the advantage that returning the pump piston or pistons by means of springs can be dispensed with; additionally, the suction chamber can be kept relatively small, since because the movable wall is provided, the abrupt load exerted on the suction chamber by the fuel, output into the suction chamber at the end of the pumping stroke that is effective for injection and that was previously brought to injection pressure, is reduced, because the movable wall yields to the pressure surge in the direction of the cam drive chamber, which is at a lower pressure, and catches the outflowing quantity. In the filling stroke of the pump piston, the filling process is positively reinforced by the simultaneous change in volume in the suction and cam drive chambers.

The invention thus makes it possible to embody the fuel reservoir larger than known reservoirs disposed on the outside, without having to accept unfavorable external dimensions of the fuel injection pump into the bargain. Already existing components are utilized as the fuel reservoir, and since the fuel reservoir according to the invention need not be flanged to the outside of the fuel injection pump, additional sealing points that could come to leak are dispensed with. In an advantageous version of the invention, the hollow chamber utilized as the fuel reservoir is defined by a housing that at least partially surrounds the pump cylinder or cylinders.

In the cam drive chamber of the fuel injection pump, the tappets actuating the pump piston or pistons are typically kept in contact with the cam by means of springs. In radial piston pumps, such spring elements may be omitted; the contact of the tappets with the cam is assured hydraulically. Then, however, the pressure in the motor chamber must be lowered to markedly below that in the suction chamber of the pump piston. The pressure in the suction chamber must therefore be kept high even in the intake stroke, and this is made possible by the large-volume fuel reservoir created by the invention.

According to the invention, the wall dividing the cam drive chamber from the component that has the pump cylinder or cylinders, or a part of this wall, is formed by a deformable diaphragm. Joining the cam drive chamber to the component that has the pump cylinder or cylinders requires a seal anyway, and this seal can simultaneously be utilized to fix the diaphragm in position.

However, according to the invention, the arrangement may also be such that the wall dividing the cam drive chamber from the component that has the pump cylinder or cylinders, or a part of this wall, is embodied by a piston that is guided tightly displaceably in the component that has the pump cylinder or cylinders and/or in the cam drive chamber. Since such a piston is located inside the pump housing, an escape of fuel from the injection pump housing need not be feared in this case, either.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
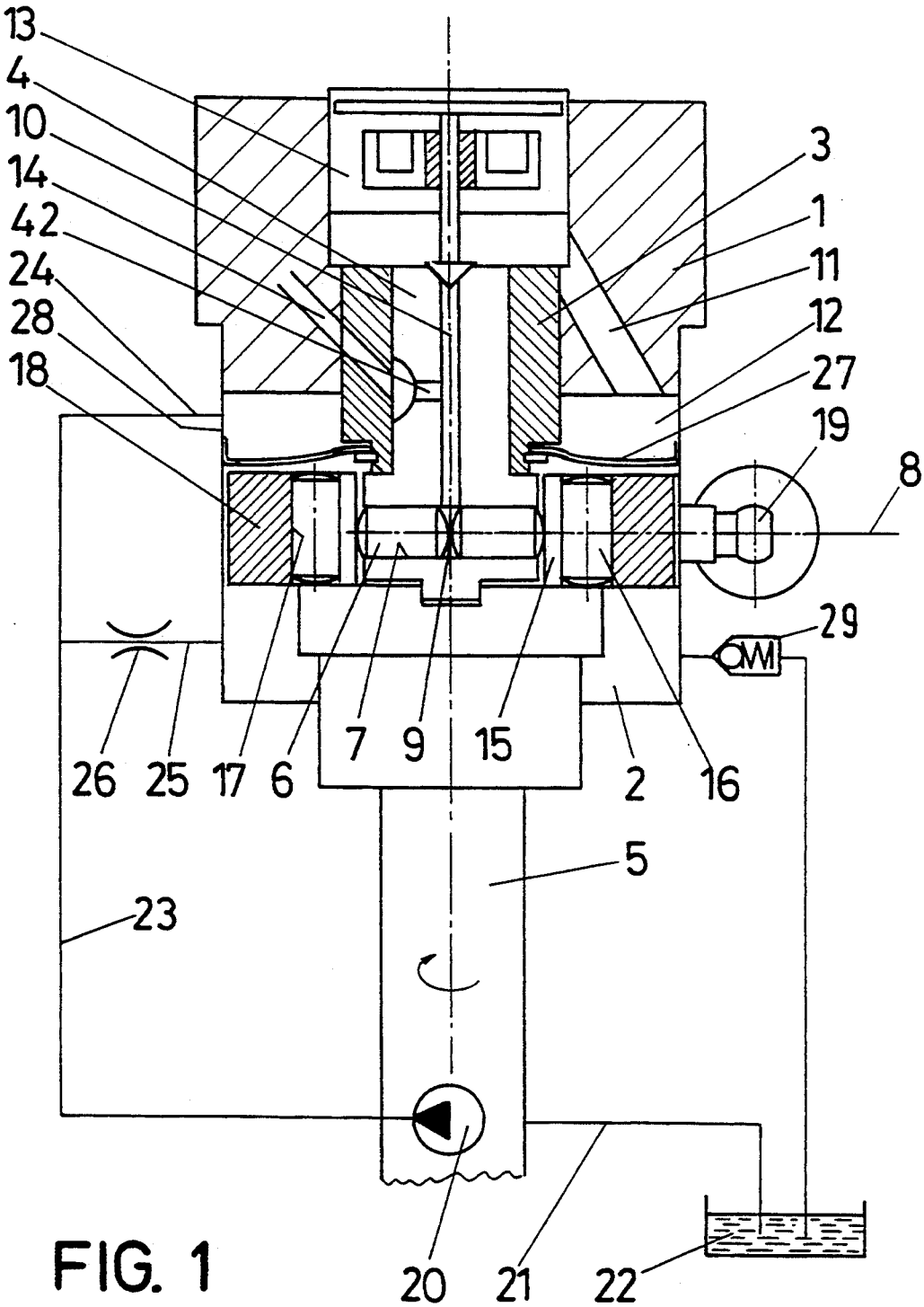
FIG. 1 shows an arrangement in axial cross section in which the pressure-sensitive device that divides the cam drive chamber from the component that has the pump cylinder or cylinders is embodied by a diaphragm.

FIG. 1 schematically shows a fuel injection pump, with a housing 1 and a cam drive chamber 2. A cylinder liner 3 is inserted into the housing 1, and a distributor 4 that is driven to rotate by a drive shaft 5 is guided in this liner. Pump pistons 6 are guided in pump cylinders 7 provided radially in the distributor, and between the pump pistons, a pump work chamber 9 is enclosed. By way of an axial conduit 10 in the distributor 4 and by way of a transverse bore 42, branching off from it, whose outlet from the distributor serves as a distributor opening, the pump work chamber 9 can be made to communicate successively in the course of distributor rotation during pump motions of the pump pistons 6 with one of a plurality of injection lines 14, which extend in the housing 1 of the fuel injection pump and lead to the individual injection points of the associated internal combustion engine. The pump pistons 6 are driven for their pumping motion via roller tappets 15 having rollers 16, which travel on a radially inwardly oriented cam race 17 of a cam ring during the rotation of the distributor. The cam ring is substantially fixed and can be adjusted via a tang 19, which is engaged by an injection adjusting piston, in order to adjust the injection onset.

On the face end of the distributor, the axial conduit 10 discharges into a fuel chamber, which via a line 11 communicates with a suction chamber 12 in the housing of the fuel injection pump. The orifice of the axial conduit 10 into this chamber is controlled by a magnet valve 13, in such a way that with the magnet valve opened, the pump work chamber 12 can be supplied with fuel during the intake stroke of the pump pistons 6. At the onset of effective pumping of fuel at high pressure into one of the injection lines 14, the magnet valve is closed and thus determines both the injection onset and the duration for which during the pumping stroke of the pump piston fuel is pumped at high pressure. Thus the injection onset and the injection quantity are varied with the aid of a single magnet valve.

For supplying the suction chamber with fuel, a forepump 20, via a line 21, aspirates fuel from a fuel tank 22 and feeds it into the suction chamber 12 via lines 23 and 24. Branching off from line 23 is a branch line 25 by way of which fuel is pumped into the cam drive chamber 2 of the fuel injection pump. This cam drive chamber 2 is relieved to the fuel tank via a pressure holding valve 29, which controls the pressure in the motor chamber. A decoupling throttle 26 is inserted into the line 25 in order to assure that a pressure in the cam drive chamber 2 that is lower than that in the suction chamber 12 can be established with the pressure holding valve 29.

The suction chamber 12 is divided from the cam drive chamber 2 by a movable wall, which is formed here by a diaphragm 27. The suction chamber is annular; it is defined circumferentially by the cylinder liner 3 and the cylindrical housing wall 28, and axially by the diaphragm 27 on one end and the pump housing on the other. The diaphragm 27 is annular; it rests tightly against the cylindrical housing wall 28 on one side and on the cylindrical circumferential wall of the cylinder liner 3 protruding into the suction chamber 12 on the other side. The cylindrical housing wall 28 and the circumferential wall of the cylinder liner 3 form an annular chamber, at least in the region of the diagram 27, the annular chamber being coaxial with the axis of the distributor piston 4. Because of this embodiment, it is unnecessary for the pistons during their intake stroke to be retained on the cam race 17 by springs via the roller tappets 15 with rollers 16. In the filling stroke of the pump pistons 6, the magnet valve 13 is opened, and the fuel, held at higher pressure, reaches the pump work chamber 9 from the suction chamber 12. The lesser cam drive chamber pressure acts upon the other face end, having the same surface area, of the pump pistons protruding into the cam drive chamber 2, so that as a result of the pressure difference, the pistons are displaced outward until they contact the cam race via the roller tappets.

If in the pumping stroke that follows the intake stroke of the pump piston, by opening of the magnet valve 13, some of the fuel pumped by the pump piston is pumped back into the suction chamber 12 via the conduits 10 and 11 rather than being pumped at high pressure into the injection nozzles, then the diaphragm 27 can deflect elastically toward the cam drive chamber 2 and hence facilitate the rapid lowering of pressure in the pump work chamber 9.

The cam drive chamber 2 may also be filled with lubricant, such as motor oil. In that case, the line 25 and the throttle 26 are omitted, and a separate device for delivering motor oil, for instance from the engine, at suitable pressure into the motor chamber 2 must be provided.

Figure 2:
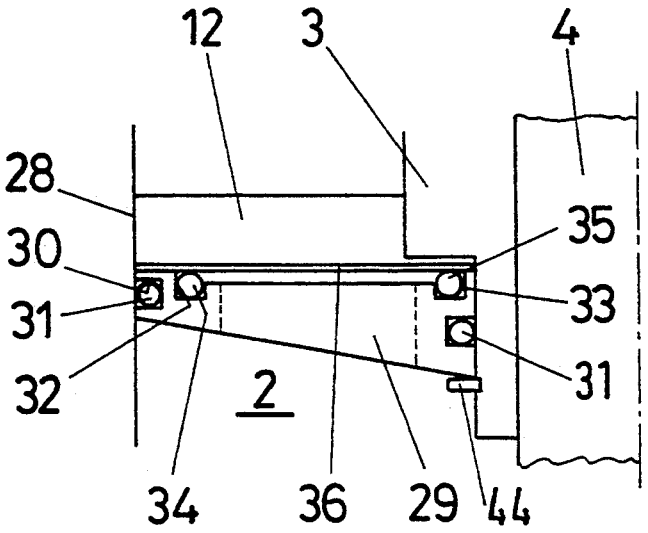
FIGS. 2 and 3, in axial section, each show only one half of two modified embodiments.

In the version of FIG. 2, a support body 29 is provided, which is tightly connected to the cylinder liner 3 and the cylindrical housing wall 28. On its peripheries, the support body 29 has circumferential grooves 30, into each of which a sealing ring 31 is placed. On its face end pointing toward the suction chamber 12, the support body has an outer annular groove 32 and an inner annular groove 33, in which sealing rings 34 and 35 are placed. A flexible plate or diaphragm 36 rests on these sealing rings 34 and 35 and is held in its position by the difference between the pressure in the suction chamber 12 and that in the motor chamber 2. Under the influence of the differential pressure acting on the diaphragm 36, the support body is supported on a stop 44 on the cylindrical outer wall of the cylinder liner 3.

Figure 3:
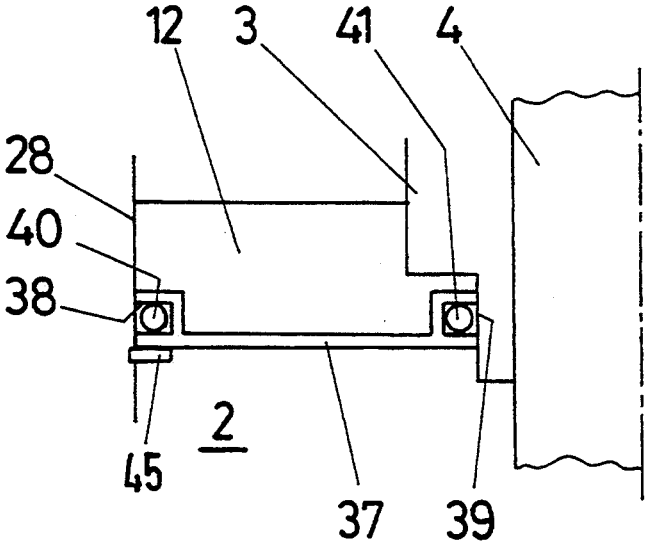

In the version of FIG. 3, the movable wall that divides the suction chamber 12 from the cam drive chamber 2 is formed by a piston 37. On its outer and inner circumference, this piston has annular grooves 38 and 39, in which sealing rings 40 and 41 are disposed. By means of these sealing rings, the piston 37, which is axially displaceable, is guided tightly along the cylindrical wall 28 and along the cylinder liner 3. In the process, the piston is initially held against a stop 45, which limits its travel toward the motor chamber, by the higher pressure in the suction chamber 12. The stop may be provided on the cylindrical housing wall, for instance in the form of a snap ring, or on the cylindrical outer wall of the cylinder liner 3. When pressure changes in the adjoining cam drive chamber 2 and pump work chamber 12 occur, because of the triggering and filling processes of the pump work chamber, the piston can then easily move axially back and forth.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel distributor injection pump for internal combustion engines, having at least one pump piston (6) that is guided in a pump cylinder (7), a pump work chamber (9) on one end of said at least one pump piston and on its other end said at least one pump piston is operatively connected to a cam drive disposed in a cam drive chamber (2) supplied with lubricating fluid, for the execution of pumping and intake strokes; a movable wall (27) that encloses a suction chamber (12), supplied from a fuel source and filled with fuel, in the interior of the fuel injection pump and said movable wall dividing said suction chamber from the cam drive chamber (2), from said suction chamber (12) fuel being delivered to the pump work chamber (9) in an intake stroke of the pump piston (6) and fuel to said suction chamber (12) controlled by a magnet valve (13) that is disposed in a relief conduit (10) of the pump work chamber (9), remaining fuel pumped by the pump piston (6) relieved at an end of a controlled pumping stroke of the pump piston by said magnet valve (13) that is effective for injection, the pump cylinder (7) disposed with its axis in a radial plane (8) of a rotationally driven distributor (4), which is guided in a cylinder liner (3) placed in the housing of the fuel injection pump, a cam ring (18) encompassing the distributor (4) disposed in the radial plane (8) in which the pump cylinder (7) is located, a cam race (17) is oriented toward the pump piston (6) and protruding from the pump cylinder (7), between said cam race and the pump piston, a pump tappet (15) is disposed, such that the fuel pressure in the suction chamber (12), during operation of the fuel injection pump, is always greater than the fluid pressure in the cam drive chamber (2), so that the pump piston follows the cam race (17) as a result of the pressure difference between the suction chamber pressure and the cam drive chamber pressure.

2. A fuel injection pump as defined by claim 1, in which the movable wall (27, 36, 37) comprises an annular part that is disposed in a cylindrical annular chamber that is coaxial with the axis of the distributor (4), which annular chamber is at least a part of the suction chamber (12) and the cam drive chamber (2).

3. A fuel injection pump as defined by claim 2, in which the annular chamber is formed by an outer wall of the cylinder liner (3) and a circular-cylindrical inner wall of the housing (1), which receives the cam of the fuel injection pump.

4. A fuel injection pump as defined by claim 1, in which the movable wall is an elastically deformable wall (22, 36).

5. A fuel injection pump as defined by claim 2, in which the movable wall is an elastically deformable wall (22, 36).

6. A fuel injection pump as defined by claim 3, in which the movable wall is an elastically deformable wall (22, 36).

7. A fuel injection pump as defined by claim 1, in which the movable wall is a piston part (37) that is displaceable along the cylindrical walls of the annular chamber.

8. A fuel injection pump as defined by claim 2, in which the movable wall is a piston part (37) that is displaceable along the cylindrical walls of the annular chamber.

9. A fuel injection pump as defined by claim 3, in which the movable wall is a piston part (37) that is displaceable along the cylindrical walls of the annular chamber.

10. A fuel injection pump as defined by claim 1, in which the movable wall is supported on a support body (29) that is guided between the cylindrical walls of the annular chamber.

11. A fuel injection pump as defined by claim 2, in which the movable wall is supported on a support body (29) that is guided between the cylindrical walls of the annular chamber.

12. A fuel injection pump as defined by claim 3, in which the movable wall is supported on a support body (29) that is guided between the cylindrical walls of the annular chamber.

13. A fuel injection pump as defined by claim 10, in which the support body (29), on its face end, has two annular grooves (32, 38) pointing toward the suction chamber, sealing rings are disposed in said annular grooves, said elastically deformable wall (36) comes to rest in the support body as a result of a pressure difference between the pressure in the suction chamber (12) and the pressure in the cam drive chamber (2).

14. A fuel injection pump as defined by claim 11, in which the support body (29), on its face end, has two annular grooves (32, 38) pointing toward the suction chamber, sealing rings are disposed in said annular grooves, said elastically deformable wall (36) comes to rest in the support body as a result of a pressure difference between the pressure in the suction chamber (12) and the pressure in the cam drive chamber (2).

15. A fuel injection pump as defined by claim 12, in which the support body (29), on its face end, has two annular grooves (32, 38) pointing toward the suction chamber, sealing rings are disposed in said annular grooves, said elastically deformable wall (36) comes to rest in the support body as a result of a pressure difference between the pressure in the suction chamber (12) and the pressure in the cam drive chamber (2).

16. A fuel injection pump as defined by claim 7, in which the movable wall (37) has annular grooves (38, 39), pointing toward the walls of the annular chamber, and one sealing ring (40, 41) is placed in each of said grooves.

17. A fuel injection pump as defined by claim 8, in which the movable wall (37) has annular grooves (38, 39), pointing toward the walls of the annular chamber, and one sealing ring (40, 41) is placed in each of said grooves.

18. A fuel injection pump as defined by claim 9, in which the movable wall (37) has annular grooves (38, 39), pointing toward the walls of the annular chamber, and one sealing ring (40, 41) is placed in each of said grooves.

19. A fuel injection pump as defined by claim 1, in which the movable wall, on the side of the cam drive chamber, is held at least indirectly in contact with one of the cylindrical walls of the annular chamber by the pressure difference between the pressure in the suction chamber (12) and the pressure in the cam drive chamber (2).

20. A fuel injection pump as defined by claim 1, in which the cam drive chamber (2) is filled with fuel.

21. A fuel injection pump as defined by claim 1, in which the cam drive chamber (2) is filled with lubricating oil.

* * * * *